US005339790A

United States Patent [19]

Smith

[11] Patent Number: 5,339,790

[45] Date of Patent: Aug. 23, 1994

[54] LIMB ATTACHMENT FOR ARCHERY BOW

[75] Inventor: Allan F. Smith, Tucson, Ariz.

[73] Assignee: Precision Shooting Equipment, Inc., Tucson, Ariz.

[21] Appl. No.: 38,855

[22] Filed: Mar. 29, 1993

[51] Int. Cl.[5] ..... F41B 5/10; F41B 5/00

[52] U.S. Cl. ..... 124/25.6; 124/23.1

[58] Field of Search ..... 124/23.1, 24.1, 25.6, 124/86, 88

[56] References Cited

U.S. PATENT DOCUMENTS

| | | | |
|---|---|---|---|
| 3,502,063 | 3/1970 | Bear | 124/23.1 |
| 3,814,075 | 6/1974 | Hoyt | 124/23.1 |
| 3,942,506 | 3/1976 | Izuta | 124/88 X |
| 4,091,790 | 5/1978 | Hoyt | 124/88 X |
| 4,201,182 | 5/1980 | Butler | 124/25.6 |
| 4,287,867 | 9/1981 | Islas | 124/25.6 |
| 4,494,521 | 11/1985 | Quartino | 124/23.1 |
| 4,674,468 | 6/1987 | Izuta | 124/23.1 |
| 4,781,168 | 11/1988 | Lester | 124/25.6 |
| 5,172,679 | 12/1992 | Mussack | 124/25.6 |
| 5,231,970 | 8/1993 | Ploot et al. | 124/23.1 |

*Primary Examiner*—Randolph A. Reese
*Assistant Examiner*—John A. Ricci
*Attorney, Agent, or Firm*—Cahill, Sutton & Thomas

[57] ABSTRACT

The limb in each pocket of a compound archery bow is separated from the pocket by a free-floating pivot having tabs at each end extending between the limb and the pocket and by an end cap separating the end of the limb from the pocket. A flange on the end cap extends past the inside surface of the limb to prevent the limb from being overtightened by contact with the inside of the limb pocket when the limb bolt is overtightened.

11 Claims, 2 Drawing Sheets

LIMB ATTACHMENT FOR ARCHERY BOW

BACKGROUND OF THE INVENTION

This invention relates to archery bows and, in particular, to a limb attachment for a compound bow.

A compound bow differs from a long bow in that a block and tackle mechanism is used to bend the bow: pulleys or wheels are attached at the free ends of the limbs to obtain a mechanical advantage in bending the bow. The limbs can be made approximately three times as stiff as for a longbow of the same draw weight. Eccentrically mounted wheels enable one to use a much higher maximum draw weight because they provide a substantial "let off" or reduction in the holding force of a drawn bow. The combination of stiffer limbs and greater draw weight applies large forces to the components of a compound bow.

A compound bow is typically made in three pieces: an elongated, rigid handle and a pair of limbs. The limbs overlap the ends of the handle a short distance and are cantilever mounted to the ends of the handle. A pocket in each end of the handle receives the end of a limb. Each limb is held in place by a limb bolt passing through a hole or slot at one end of the limb and engaging a threaded bore in the pocket. A semi-circular depression at the outer end of each pocket receives a half-round member having its flat side attached to the underside of the limb. The underside of the limb does not touch the handle but rests on the half-round member, about which the limb can pivot as the limb bolt is tightened or loosened.

As used herein, the "underside" or "inside" of a limb is the generally concave side, i.e. the side facing an archer holding a drawn bow. The "outside" surface of a limb is the generally convex side facing the target.

The distance from the pivot to the free end of the limb is considerably greater than the distance from the pivot to the limb bolt. The large forces in the bow are therefore concentrated at the connection of the limb to the handle, particularly at the pivot. The limb bolt, which is used for adjusting the draw weight of the bow, is not located in a closely fitting hole or slot. Thus, the limb is located by the pivot, where the forces are concentrated.

There are problems with this construction of a compound bow. A first problem is the large shear force on the pivot as the bow is drawn and fired. The adhesive between the pivot and the limb must be able to withstand the longitudinal forces on the limb. A second problem is that the placement of the pivot is critical. Any slight misalignment of the pivot causes the limbs to be out of alignment with the handle, increasing the shear forces on the pivot and possibly causing the limb to rub and wear in the pocket. Thus, the gluing operation is a critical manufacturing step.

Another problem is that the limb bolt is often overtightened by an archer seeking to increase the draw weight of his bow. Overtightening can split the end of the limb or break the pivot by forcing the limb to move longitudinally.

In view of the foregoing, it is therefore an object of the invention to provide an improved limb attachment for a compound archery bow.

Another object of the invention is to simplify the manufacture of compound archery bow.

A further object of the invention is to prevent overtightening of limb bolts in compound bows.

Another object of the invention is to eliminate shear forces on the pivot of a compound bow.

A further object of the invention is to provide a self-centering assembly of limbs in the pockets of the handle of a compound bow.

SUMMARY OF THE INVENTION

The foregoing objects are achieved in the invention in which a free-floating, half-round pivot includes tapered tabs extending between the sides of the limb and a limb pocket for locating the limb between the sides of the pocket. A cap covering the end of the limb is held in place by a limb bolt. A flange on the cap covers the end of the limb, separating the end of the limb from the end of the pocket. The flange also extends past the underside of the limb to engage the bottom of the pocket when one attempts to overtighten the limb bolt, preventing damage to the end of the limb and preventing the limb from being overtightened.

BRIEF DESCRIPTION OF THE DRAWINGS

A more complete understanding of the invention can be obtained by considering the following detailed description in conjunction with the accompanying drawings, in which

In FIG. 1, compound bow 10 includes handle 11 having grip 12, by which the archer holds the bow. Limbs 14 and 15 overlap the ends of handle 11, resting in pockets 16 and 17. Pocket 16 in the upper end of handle 11 receives one end of limb 14, secured by limb bolt 25. Pocket 17 in the lower end of handle 11 receives one end of limb 15, secured by limb bolt 26. Wheels 21 and 22 are located in clefts in the free ends of limbs 14 and 15. Lacing 23 interconnects the limbs and wheels and holds these pieces in place on handle 11. At the ends of handle 11, underneath the limbs, are the pivots (not shown in FIG. 1) against which the limbs are braced for bending.

FIG. 2 illustrates a half round pivot of the prior art. Limb 31 is attached to handle 32 by bolt 33. The flat side of pivot 34 is glued to the underside of limb 31 and the curved side of pivot 34 rests in recess 35 in the end of handle 32. Pivot 34 must be located precisely on limb 31 to assure that there is a gap between the end of limb 31 and handle 32. Pivot 34 is a fulcrum on which limb 34 rests, held on one side by the lacing (not shown in FIG. 2) and on the other end by bolt 33. Thus, the forces on the limb are concentrated on pivot 34 as it separates limb 31 from handle 32.

FIG. 3 illustrates another, known pivot which uses ball bearings. Specifically, bearing 36 rests in dimple 37 in limb 38 and rests in spherical depression 39 in handle 41. Bearing 36 is spherical and is one of two such bearings adjacent each other under each side of limb 38. A second ball bearing, hidden by bearing 36, typically rides in a depression elongated in the direction of the width of limb 38. The elongation prevents a mismatch between the spacing of the bearings attached to limb 38 and the spacing of the depressions in handle 41. Since bearing 36 rests in spherical depression 39, it locates limb 37 both longitudinally and transversely on handle 41.

Both the half round and ball bearing pivots are subject to large sheer forces as the bow is drawn and fired. If the pivot separates from the limb, the end of the limb could rub on the handle and eventually crack or split. These problems are overcome in a bow constructed in accordance with the invention in which the pivot is free floating and includes tabs for locating the limb transversely within a limb pocket. In addition, a cap longitudinally locates the end of the limb in the pocket and separates the end of the limb from the pocket.

Figure 4:
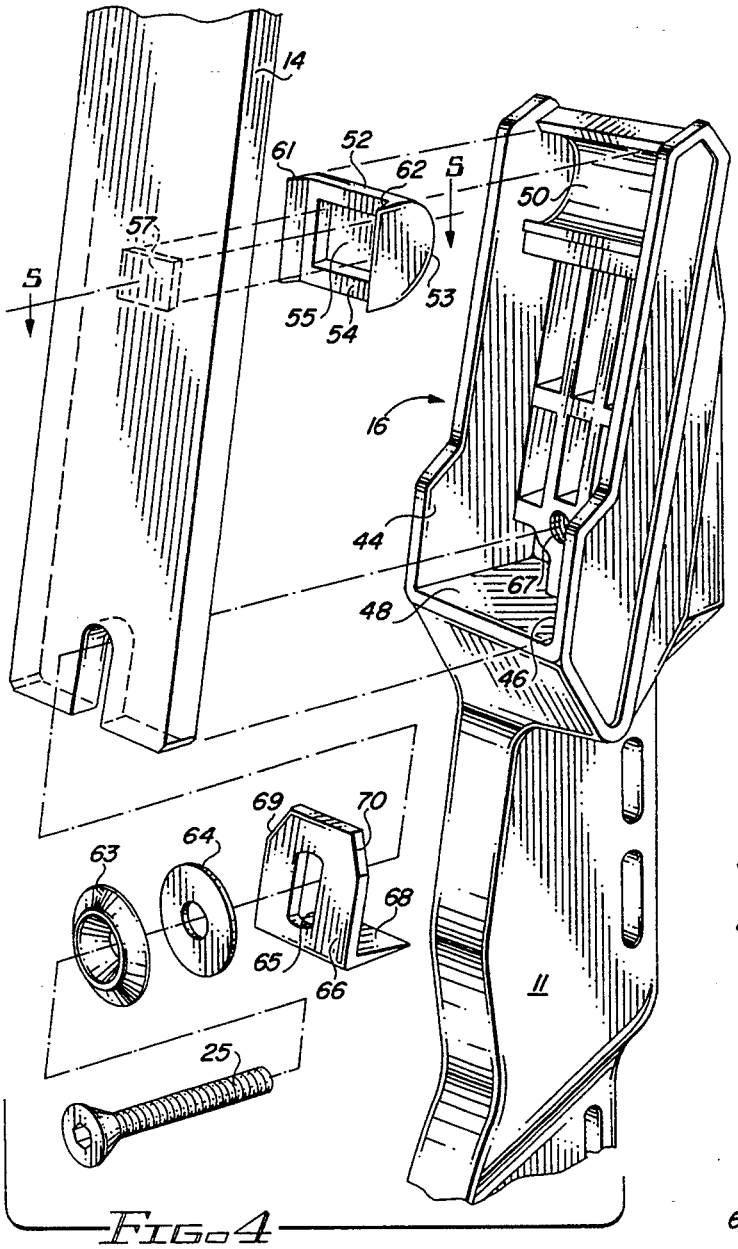
FIG. 4 is an exploded view of a limb pivot constructed in accordance with a preferred embodiment of the invention.

FIG. 4 illustrates in detail the construction and assembly of limb 14 and handle 11 in accordance with the invention. Handle 11 is cast or milled from aluminum, magnesium, or other light weight metal or alloy and includes pocket 16 in the upper end thereof. Pocket 16 includes side walls 44 and 46 and end wall 48. Adjacent the upper end of limb 11 is recess 50 for receiving pivot 52. Pivot 52 includes half round outer surface 53 and flat surface 54.

Recess 55 is formed within flat surface 54 to clear molded pad 57 on the underside of limb 14. Recess 55 and molded pad 57 can be eliminated if desired. If not eliminated, for example because molded pad 57 is used as a reference mark in the manufacture of limb 14, then molded pad 57 preferably has a perimeter smaller than the perimeter of recess 55. This provides a clearance so that pad 57 does not engage the sides of the recess and limit the movement of pivot 52 relative to limb 14. For example, a clearance of one eighth of an inch from all four sides of recess 55 is sufficient.

Figure 5:
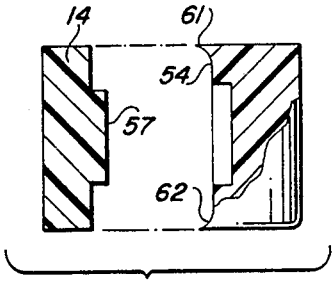
FIG. 5 illustrates a pivot constructed in accordance with a preferred embodiment of the invention.

The sides of pivot 52 extend upward around the sides of limb 14, forming tabs 61 and 62, also illustrated in FIG. 5. Tabs 61 and 62 are tapered, being thicker at the base where they intersect surface 54 and decreasing in thickness as they extend along the sides of limb 14. This provides a self-centering action for limb 14 within tabs 61 and 62. Pivot 52 fits closely within recess 50 between walls 44 and 46 and limb 14 fits closely between tabs 61 and 62.

While pivot 52 is preferably a half round member, it is understood that the curved surface of pivot 52 and the complementary curved surface of recess 50 need not have semicircular cross-sections. The cross-section could be a smaller fraction of a circle or even a non-circular curve. The curve is not critical and merely serves to distribute the load from the limb over a large surface area and to enable the limb to pivot slightly as the limb bolt is adjusted. Any suitably shaped surface serving these functions can be used. Pivot 52 can be made from the same plastics as pivots of the prior art, e.g. nylon or injection molded plastic. The pivot could also be machined from aluminum.

The end of limb 14 is attached to the inside of pocket 16 by limb bolt 25 which passes through conical washer 63, flat washer 64 and slot 65 in cap 66 to engage threaded hole 67 in pocket 16. Cap 66 overlies the outside surface of the butt end of limb 14 and includes flange 68 which covers the end of the limb and extends past the underside of the limb into pocket 16. Flange 68 protects the end of limb 14 and is tapered to aid in the assembly of the bow. Limb 14 cannot rub on handle 11 since it is separated from it by flange 68, tabs 61 and 62, and the body of pivot 52.

Bevels 69 and 70 are for aesthetics only, the shape of the portion of cap 66 overlying the limb is not critical. A slot is used for the limb bolt instead of a round hole to prevent the cap from being located longitudinally on the limb by the limb bolt. A slot is used in the end of the limb for the same reason. This simplifies the manufacture and assembly of a bow because close tolerances are eliminated, yet the limb is securely and accurately located in the pocket by the pivot and end cap.

Figure 1:
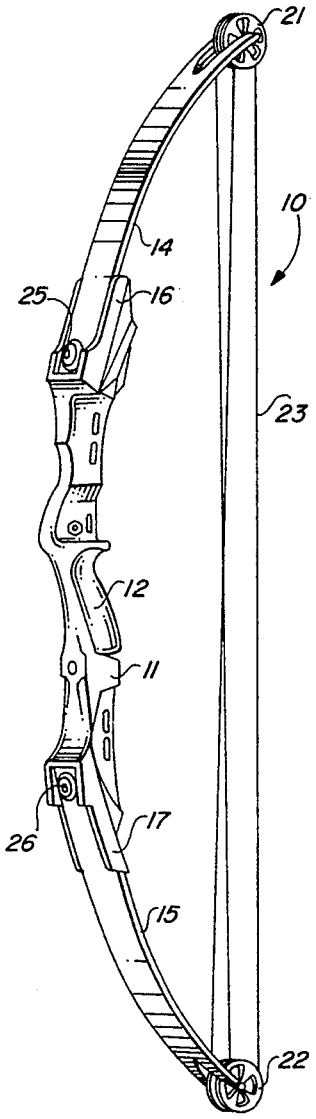
FIG. 1 illustrates the main components of a compound bow.
Figure 2:
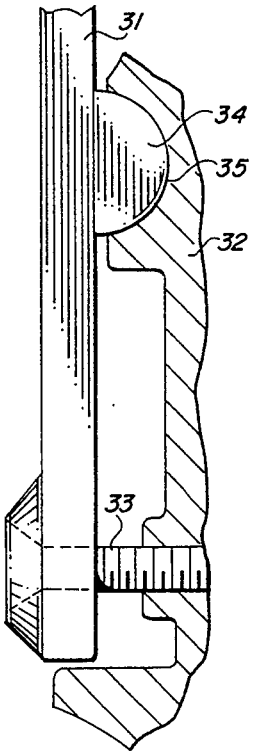
FIG. 2 (PRIOR ART)
FIG. 2 is a partial cross-section of a limb pocket and a half-round pivot of the prior art.
Figure 3:
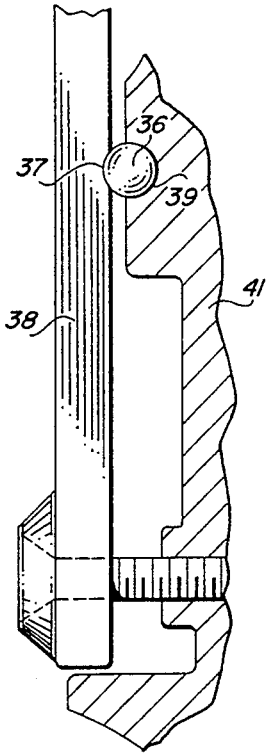
FIG. 3 (PRIOR ART)
FIG. 3 is a partial cross-section of a limb pocket and a bearing pivot of the prior art.
Figure 6:
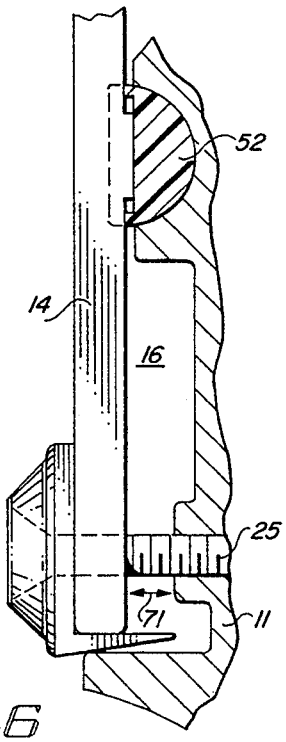
FIG. 6 shows a limb bolt properly adjusted in the pocket of the handle.
Figure 7:
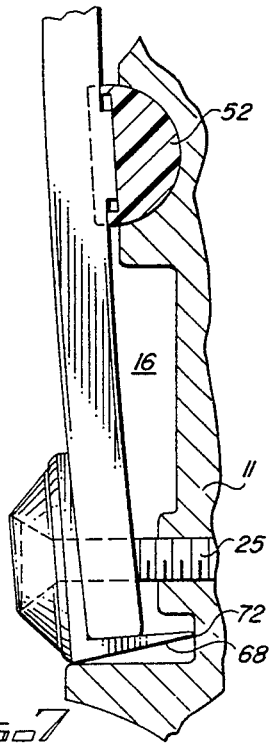
FIG. 7 shows how the butt cap prevents overtightening of the limb bolt.

FIG. 6 illustrates the position of limb 14 when properly adjusted for draw weight. Specifically, limb 14 is separated from the bottom of pocket 16 by gap 71. As limb bolt 25 is tightened, the end of limb 14 is drawn into pocket 16, as illustrated in FIG. 7. Unlike bows of the prior art, the end of limb 14 is not compressed under bolt 25 because flange 68 meets handle 11 at point 72. Thus, flange 68 sustains the compressional load from bolt 25 and protects the end of limb 14. In addition, because limb 14 does not move any closer to the bottom of pocket 16, the draw weight of the bow is not further increased and limb 14 is protected from undue stress as it is bent over pivot 52 by bolt 25 and the lacing.

Figure 8:
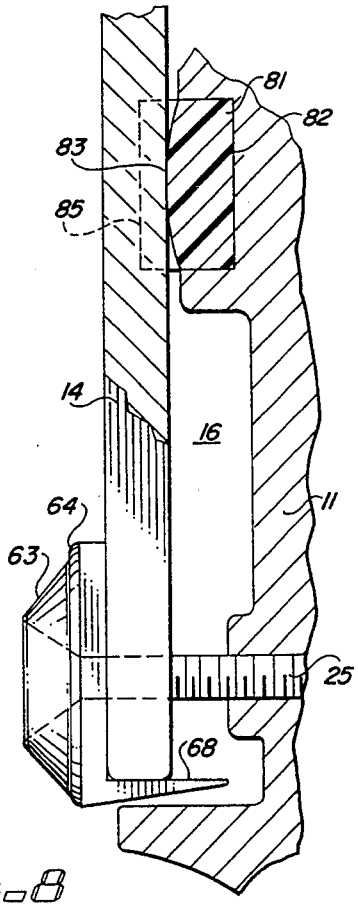
FIG. 8 illustrates a limb pocket constructed in accordance with an alternative embodiment of the invention.

FIG. 8 illustrates a limb pocket constructed in accordance with an alternative embodiment of the invention in which the limb rests on the convex surface of the pivot. Limb bolt 25 passes through conical washer 63, flat washer 64, the slot in the end of limb 14, and is threaded into handle 11 as in the embodiment of FIG. 6. Unlike FIG. 6, pivot 81 rests in rectangular recess 82 with limb 14 resting on convex face 83. Tab 85 extends past the inside surface of limb 14 along the far side of the limb (as shown in FIG. 8). Another tab, not shown, extends past the inside surface along the near side of limb 14. In operation, limb 14 flexes slightly over convex surface 83. The radius of curvature of convex surface 83 is not critical but preferably is greater than the largest dimension of the pivot.

The manufacture of a bow constructed as described above is greatly simplified as compared with the prior art. Pivot 52 or 81 is not glued to limb 14 but merely frictionally engages limb 14 and pocket 16. The placement of pivot 52 or 81 is not critical. The location of the butt end of limb 14 within pocket 16 is simplified by cap 66 since flange 68 controls the spacing between the end of limb 14 and end wall 48. Thus, not only is an improved limb attachment provided by the invention but a simplified assembly as well. Although scientific comparisons have not been made, there is also a distinct impression that a bow constructed in accordance with the invention shoots more quietly than bows of the prior art.

Having thus described the invention it will be apparent to those of skill in the art that various modifications can be made within the scope of the invention. For example, while described as having fixed pockets formed at each end of handle 11, it is understood by those of skill in the art that the present invention can be used with pivoting pockets such as the pivoting pocket described in co-pending application Ser. No. 07/780,793 filed Oct. 22, 1991. While described in con-junction with a compound bow, the invention can be used in recurve bows having separate limbs and handle.

I claim:

1. In a compound archery bow including a handle having a limb pocket at each end; first and second pivots in respective limb pockets; first and second limbs each having an inside surface and an outside surface, a first end connected to said handle, an axle connected to a second end, and a wheel mounted on said axle; and lacing connecting said wheels with said first and second limbs; the improvement comprising:

a pair of tabs on each of said first and second pivots, said tabs extending between the sides of the respective limb and the respective pocket to locate the limb in the pocket.

2. The bow as set forth in claim 1 wherein said tabs are tapered.

3. The bow as set forth in claim 1 wherein said pivots are free-floating.

4. The bow as set forth in claim 1 wherein said pivots each comprise a half-round member having first and second sides and a flat surface between said sides for contact with a limb and a curved surface, opposite said flat surface, for contact with a limb pocket and wherein said sides of said member extend past said flat surface forming said tabs.

5. The bow as set forth in claim 1 wherein said pivots each comprise a member having first and second sides and a convex surface between said sides for contact with a limb and a flat surface, opposite said convex surface, for contact with a limb pocket and wherein said sides of said member extend past said convex surface forming said tabs.

6. The bow as set forth in claim 1 and further comprising:

first and second caps on respective first ends of said first and second limbs, each of said caps having a first portion overlying the outside surface of its respective limb and a flange extending across the end of said limb into the respective limb pocket.

7. The bow as set forth in claim 6 wherein said flange extends a predetermined distance past the inside surface of said limb.

8. The bow as set forth in claim 6 wherein said flange is tapered.

9. In a compound archery bow including a handle having a limb pocket at each end; first and second pivots in respective limb pockets; first and second limbs each having an inside surface and an outside surface, a first end connected to said handle, an axle connected to a second end, and a wheel mounted on said axle; and lacing connecting said wheels with said first and second limbs; the improvement comprising:

first and second caps on respective first ends of said first and second limbs, each of said caps having a first portion overlying the outside surface of its respective limb and a flange extending across the end of said limb into the respective limb pocket.

10. The bow as set forth in claim 9 wherein said flange extends a predetermined distance past the inside surface of said limb.

11. The bow as set forth in claim 9 wherein said flange is tapered.

* * * * *